US006354375B1

(12) United States Patent
Dewey

(10) Patent No.: US 6,354,375 B1
(45) Date of Patent: Mar. 12, 2002

(54) LATERAL WELL TIE-BACK METHOD AND APPARATUS

(75) Inventor: Charles H. Dewey, Houston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/480,073

(22) Filed: Jan. 10, 2000

Related U.S. Application Data

(60) Provisional application No. 60/116,160, filed on Jan. 15, 1999, and provisional application No. 60/134,799, filed on May 19, 1999.

(51) Int. Cl.[7] ..... E21B 43/14

(52) U.S. Cl. ..... 166/313; 166/50; 166/241.1

(58) Field of Search ..... 166/313, 50, 384, 166/117.6, 117.5, 344, 241.1

(56) References Cited

U.S. PATENT DOCUMENTS

| | | | | |
|---|---|---|---|---|
| 2,797,893 A | * | 7/1957 | McCune et al. | 166/381 |
| 3,330,349 A | * | 7/1967 | Owsley | 166/285 |
| 4,396,075 A | * | 8/1983 | Wood et al. | 175/79 |
| 5,454,430 A | * | 10/1995 | Kennedy et al. | 166/50 |
| 5,467,819 A | | 11/1995 | Braddick | |
| 5,477,925 A | | 12/1995 | Trahan et al. | |
| 5,520,252 A | * | 5/1996 | McNair | 166/313 |
| 5,680,901 A | | 10/1997 | Gardes | |
| 5,875,847 A | | 3/1999 | Forsyth | |

FOREIGN PATENT DOCUMENTS

| | | |
|---|---|---|
| EP | 0310215 | 4/1989 |
| EP | 0859121 | 8/1998 |
| EP | 0900915 | 3/2000 |
| GB | 2339585 | 10/1998 |

* cited by examiner

*Primary Examiner*—Frank S. Tsay
(74) *Attorney, Agent, or Firm*—Conley, Rose & Tayon, P.C.

(57) ABSTRACT

A tie-back insert is installed in a primary wellbore and includes a housing which includes one or more axial bores therethrough and a lateral bore which extends laterally out the side of the housing. The lateral bore allows a liner to pass through the top of the insert, through the lateral bore and into the lateral borehole to a new producing formation. The annulus formed between the housing and the casing is sealed at the upper end of the housing by an upper packer and the lower end of the housing is sealed by stabbing into a lower packer. The upper and lower packers seal around the window cut in the casing. The axial bores allow production fluid from the primary wellbore to be transmitted through the insert to the surface of the well. The insert is placed within the primary wellbore so that the lateral bore is located and oriented adjacent the lateral borehole allowing production fluid from the lateral borehole to transmitted to the surface of the well.

32 Claims, 6 Drawing Sheets

FIG.5
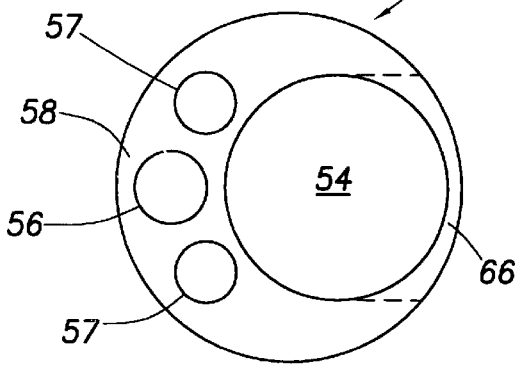
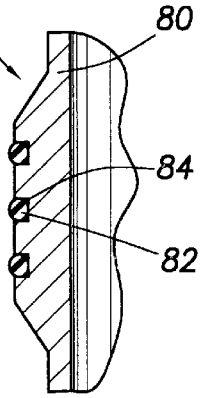
FIG.7
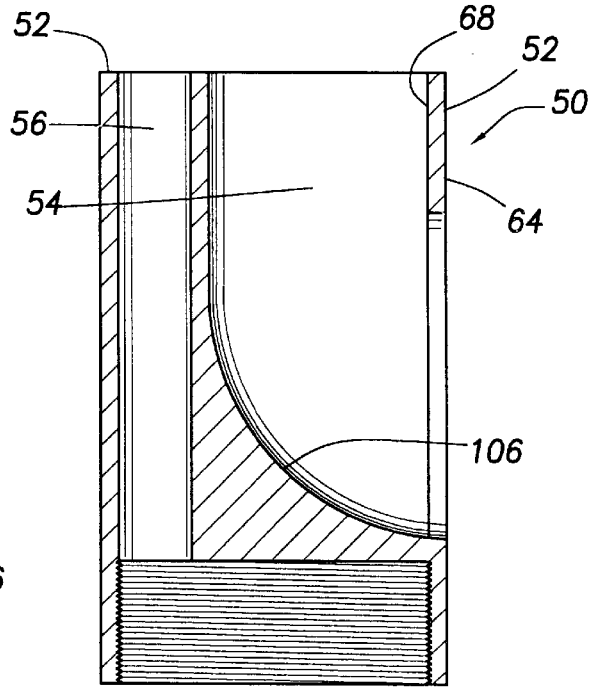
FIG.6
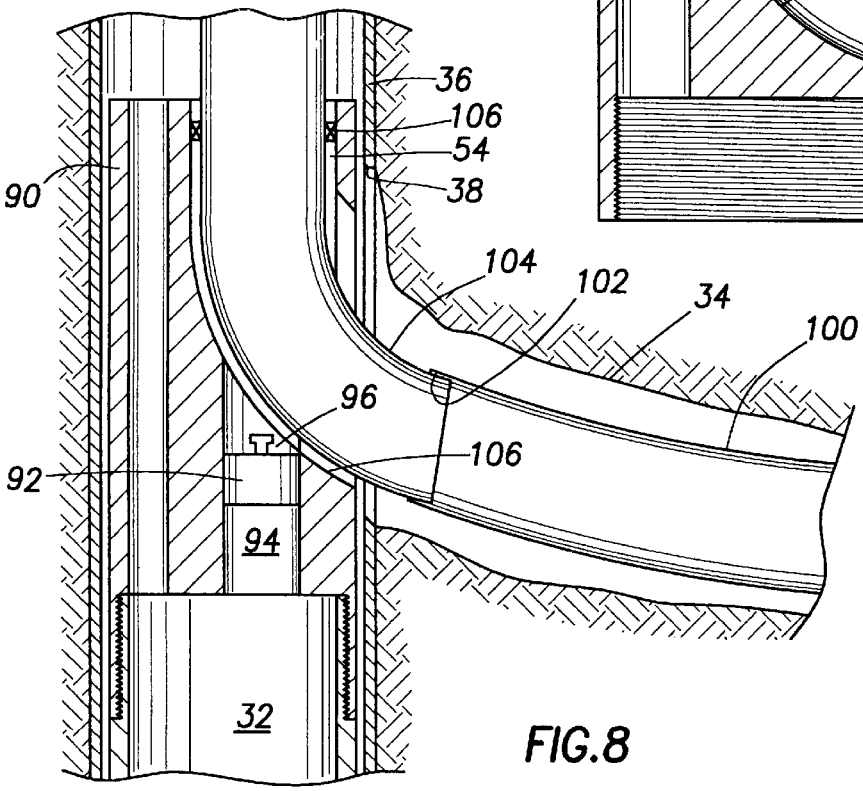
FIG.8

FIG.9
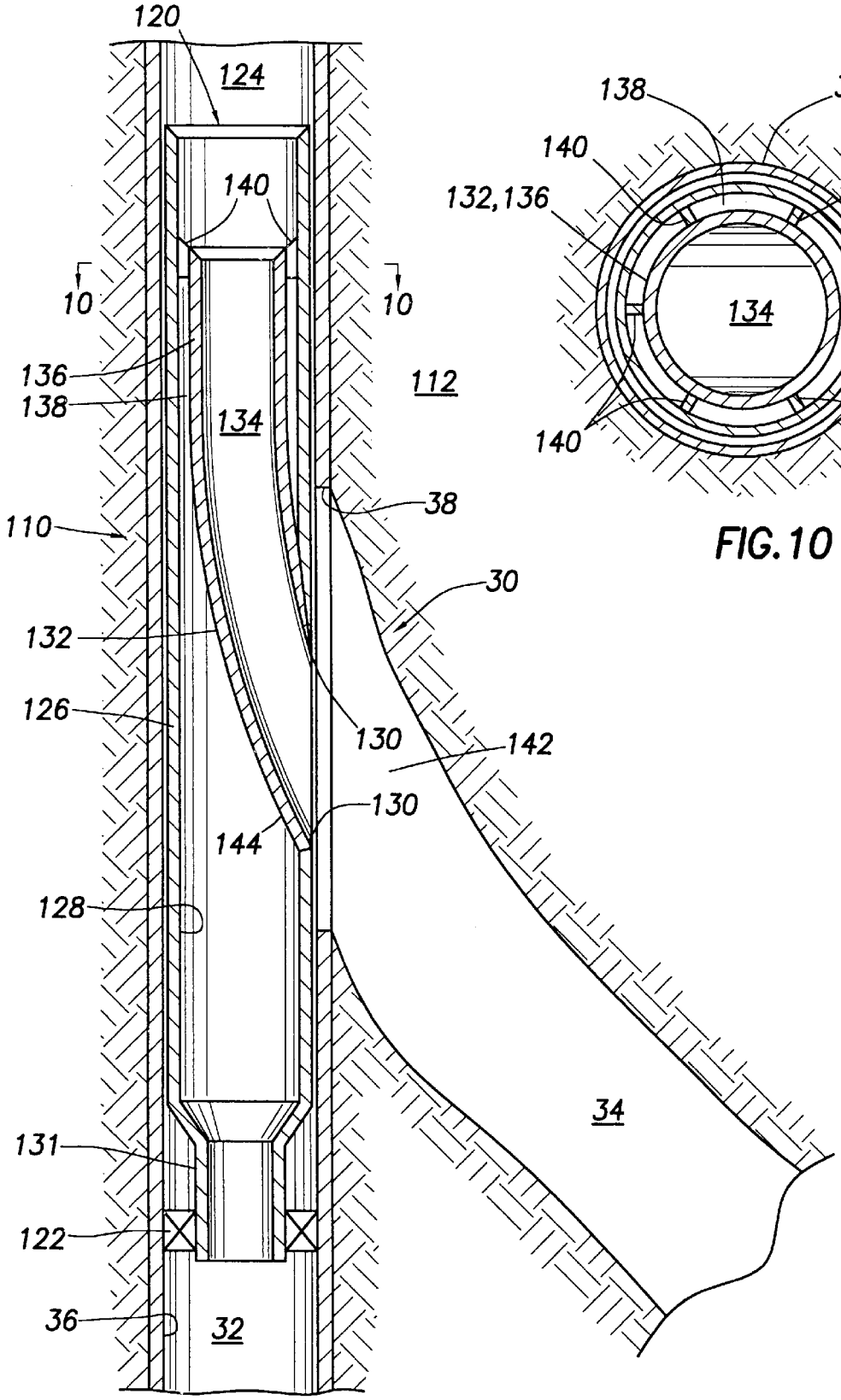
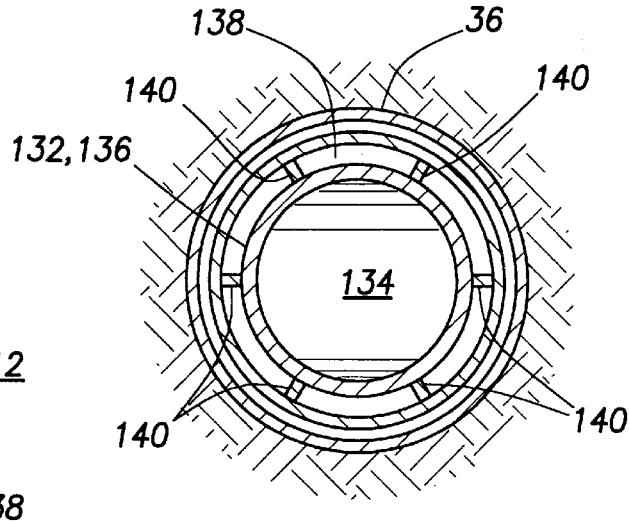
FIG.10

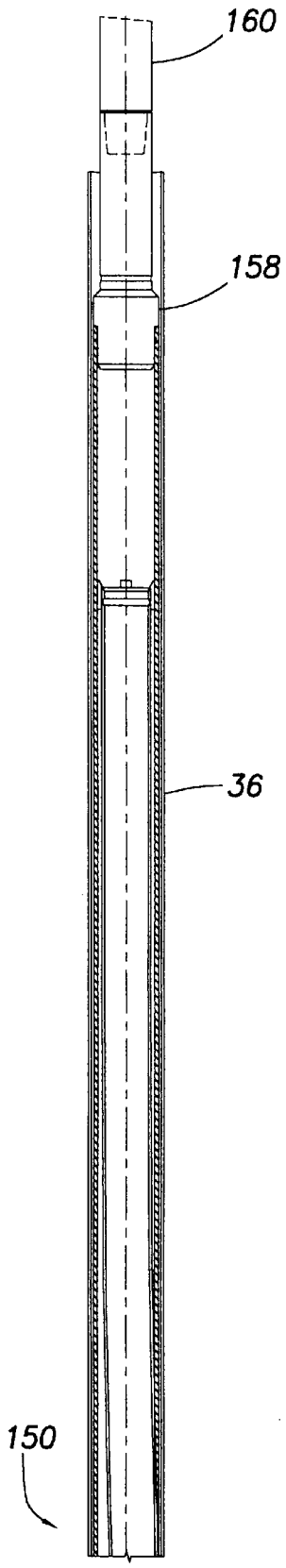
FIG. 11A1
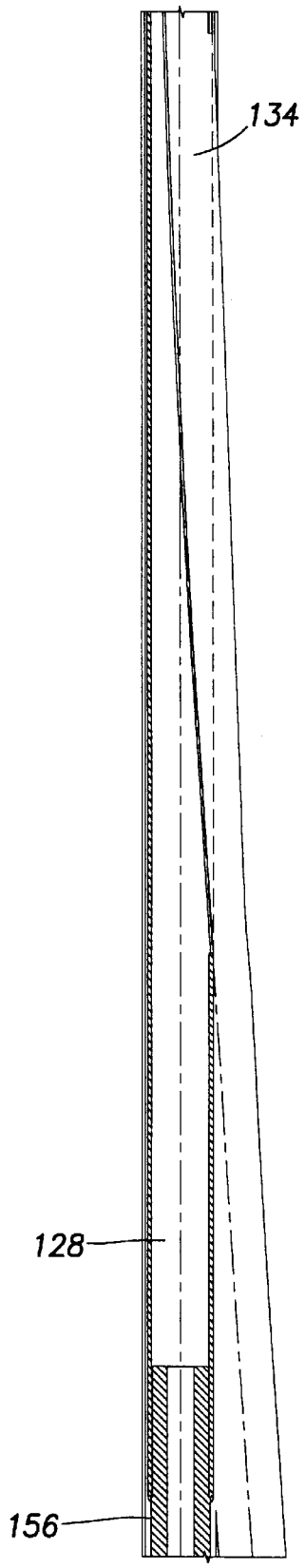
FIG. 11A2
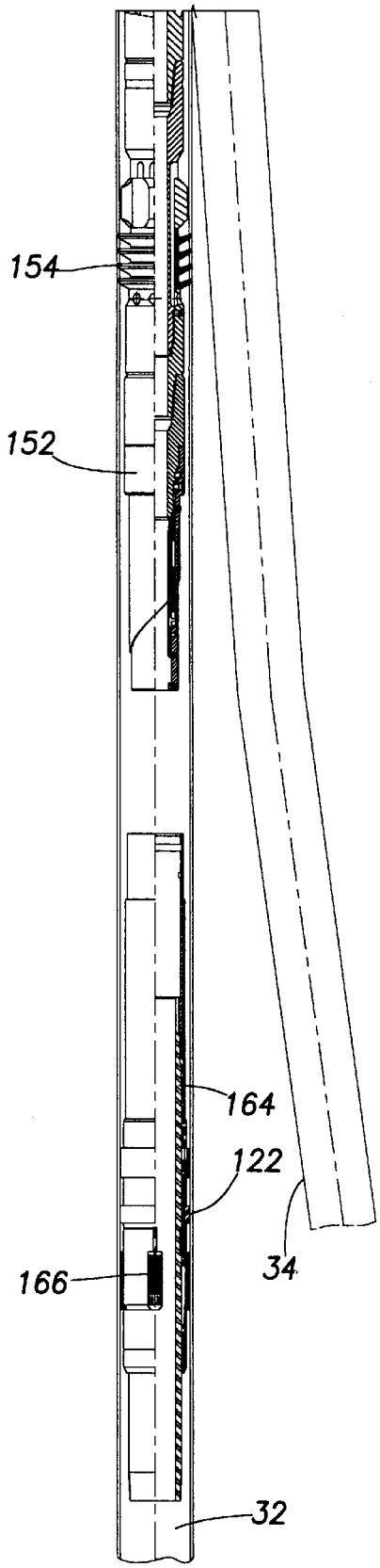
FIG. 11A3

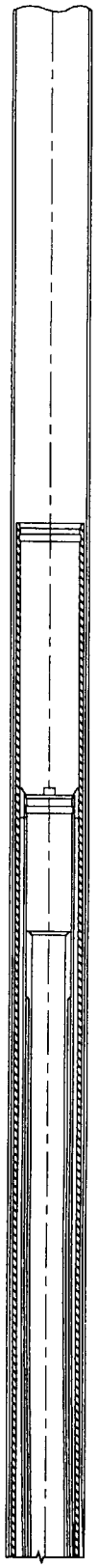
FIG. 11B1
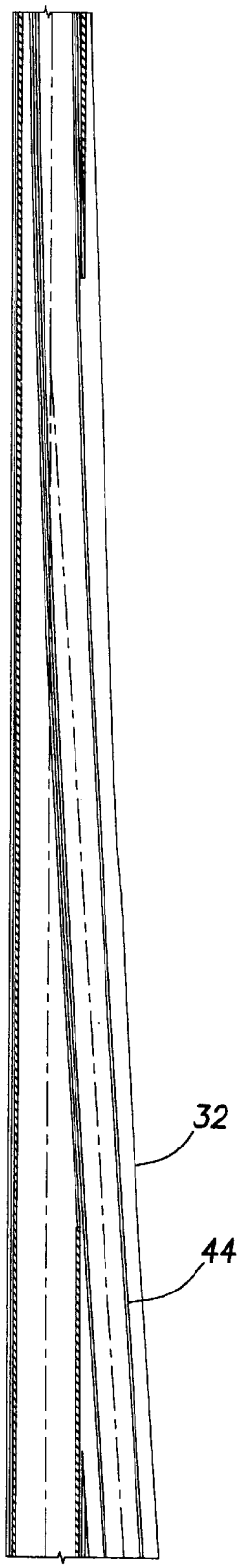
FIG. 11B2
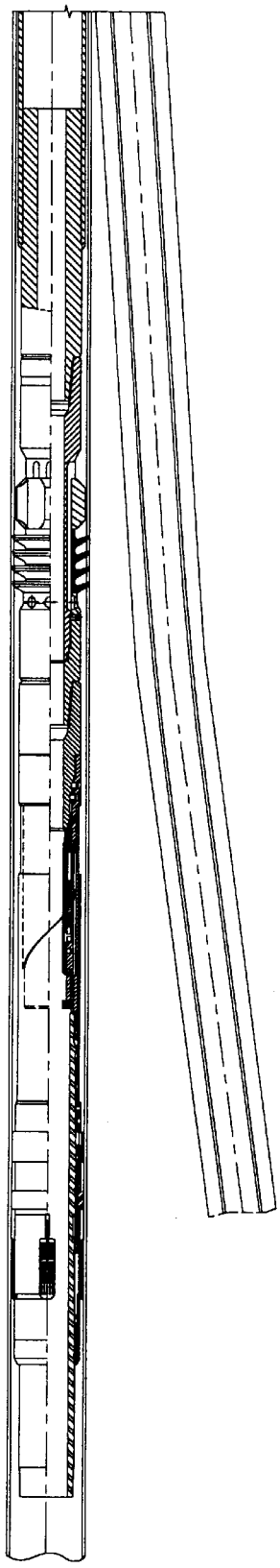
FIG. 11B3

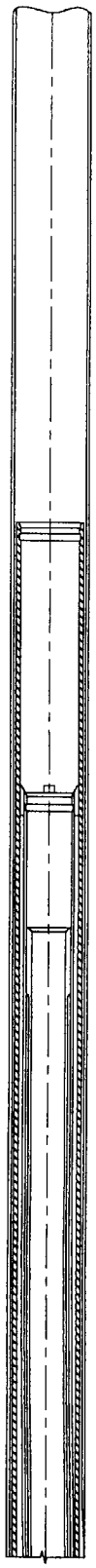
FIG. 11C1
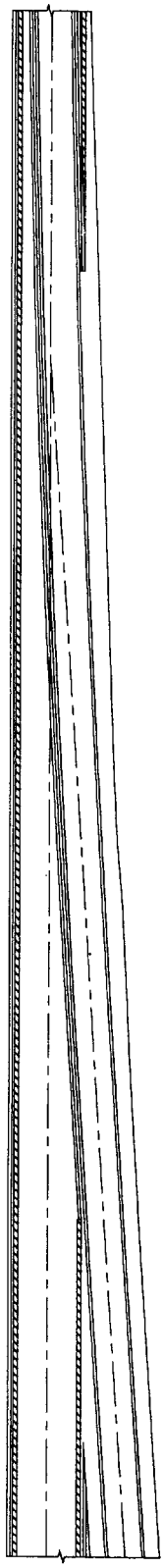
FIG. 11C2
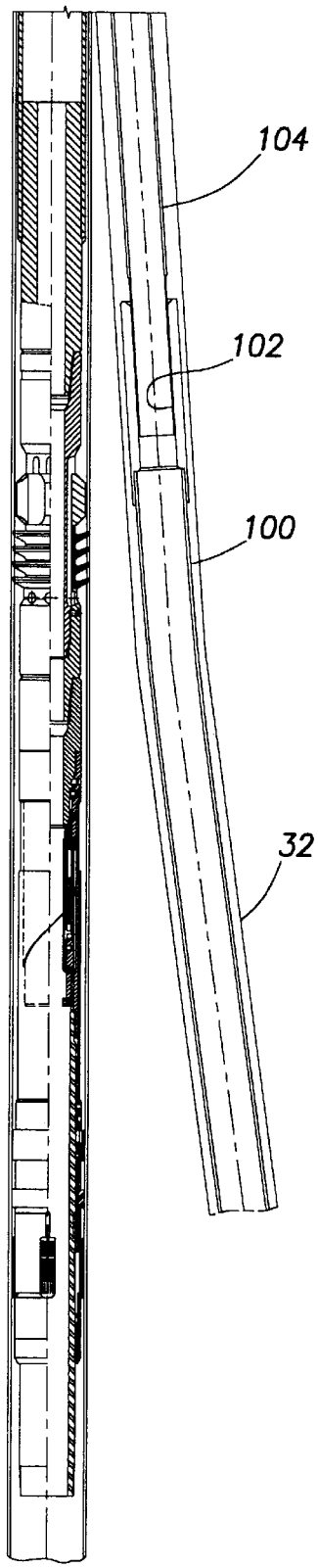
FIG. 11C3

LATERAL WELL TIE-BACK METHOD AND APPARATUS

CROSS-REFERENCE TO RELATED APPLICATIONS

The present application claims the benefit of 35 U.S.C. 35 U.S.C. 119(e) provisional application Serial No. 60/116,160, filed Jan. 15, 1999 and entitled Lateral Well Tie-Back Methods and Apparatus, and the benefit of 35 U.S.C. 35 U.S.C. 119(e) provisional application Serial No. 60/134,799, filed May 19, 1999 and entitled Well Reference Apparatus and Method, both hereby incorporated herein by reference.

BACKGROUND OF THE INVENTION

1. Field of the Invention

The present invention relates generally to apparatus and methods used in the completion of lateral wellbores and more particularly to new and improved apparatus and methods for ensuring adequate flow and production from lateral bores and still more particularly to apparatus and methods such as a tie-back insert for sealing around a window cut in a casing and extending a liner into a lateral borehole.

2. Description of the Related Art

It has become a common practice to drill deviated, and sometimes horizontal, lateral boreholes from a primary wellbore in order to increase production from a well. For example, the primary wellbore may be produced along with a lateral wellbore. Therefore, if production from the primary wellbore cannot be enhanced, the primary wellbore may be side tracked to produce the lateral borehole in order to produce another production zone in the well at the same time.

A whipstock and mill assembly is used to create a window in the wall of the casing of the primary wellhole. The lateral wellbore is then drilled through this window out into the formation where new production can be obtained.

Production from a lateral borehole can be difficult if the lateral borehole is drilled through a loose or unconsolidated formation. Formations that contain a significant amount of shale can be a particular problem. If the bore surfaces at and near the junction are not covered with a liner, chips and aggregate in this area tend to be drawn along with the produced fluids and foul the production. Unfortunately, lining the bore surfaces near the junction can be complex and time consuming.

There have been attempts to use a perforated insert through the window to allow production from both the primary bore and lateral bore while reducing contamination from chips and aggregate. The perforations are aligned with the primary bore and fluid from the primary bore passes through the perforations. Unfortunately, the perforations tend to become clogged by the chips and aggregate and allow the chips and aggregate to contaminate the product, thereby reducing the effectiveness of this type of insert.

The junction of the lateral borehole with the primary wellbore is usually ragged and rough as a result of the milling of the window through the casing to drill the lateral borehole. It is particularly difficult to seal around the window which is of a peculiar shape and has a jagged edge around its periphery.

A large area is exposed to the formations when the window is cut in the casing. A tie-back assembly may be disposed adjacent the junction of the lateral borehole and primary wellbore. See for example U.S. Pat. No. 5,680,901. The tieback assembly and liner limit the exposure of the formation through the window cut in the casing.

U.S. Pat. No. 5,875,847 discloses a multilateral sealing device comprising a casing tool having a lateral root pre-machined and plugged with cement. A profile receives a whipstock for the drilling of the lateral bore hole through the lateral root and cement plug. A lateral liner is then inserted and sealed within the lateral root.

The TAML (Technology Advancement Multi-Lateral) defines six levels for a multi-lateral junction for a lateral borehole. For example, if the liner is merely cemented at the junction, it is a level four since cement is not acceptable as a seal. Level five requires pressure integrity at the junction. Level six requires a hydraulic seal around the window for pressure integrity and full bore access to both the primary wellbore and the lateral borehole.

Various devices have been used to provide separate bores inside a primary wellbore. For example, in dual bore completions, a diverter sub has an initial single bore that is divided into two side by side bores, typically of equal diameter. A liner is hung in each of the two bores with a seal receptacle on top of the liner hanger. Additional equipment may be used with the diverter sub to cause one of the bores to communicate with a lateral borehole. The prior art scoop head or diverter or side-by-side bores include side-by-side conduits which extend axially and do not extend laterally into a lateral borehole. Further, these devices do not bridge the window cut in the casing.

One prior art device includes a large manifold that has a plurality of bores through it so that each of the bores can be used for different boreholes. The manifold includes one principal bore with three or four smaller bores, all beside each other shooting off from the main bore. The smaller bores are up to one-half the diameter of the main bore which severely reduces the size of pipe which can be used. Further the manifold is 12¼ inches in diameter and must be run on the bottom of the casing. This requires that a 12¼ inch borehole be drilled for a 9⅝ inch completion to allow the installation of 4½ inch liners in the lateral borehole and in the main bore. The borehole beneath the manifold must be under-reamed. This prior art device is used in drilling and completing a new well.

Another prior art device is a level six system which includes an insert having two legs with one of the legs being compressed and the other leg being slightly compressed. The entire assembly is run into the primary wellbore and, once in position, the two legs are expanded to form two side-by-side bores. This is equivalent to a seven inch liner access and allows the drilling of a six or 6¼ inch hole. A 4½ inch liner is then inserted into each of the bores. This system also has to be installed through a 12¼ inch hole and run in on the bottom of 9⅝ inch casing. Further, the legs have to be inflated once in position. To inflate the legs, the borehole must be bigger then a 12¼ inch borehole and thus the borehole must be under-reamed. This prior art device is used in drilling and completing a new well.

The present invention overcomes the deficiencies of the prior art.

SUMMARY OF THE INVENTION

The present invention features improved apparatus and methods for effectively obtaining production from a lateral borehole even where the formation is loose or unconsolidated. The invention includes a tie-back insert that is installed within the primary wellhole. The insert has a housing which includes one or more axial bores therethrough and a lateral bore which extends laterally out the side of the housing. The lateral bore allows a liner to extend from the top of the insert, through the lateral bore and into the lateral borehole to the new producing formation. The annulus formed between the housing and the casing is sealed at the upper end of the housing by an upper packer and the lower end of the housing is sealed by stabbing into a lower packer. The upper and lower packers seal around the window cut in the casing. The axial bores allow production fluid from the primary wellbore to be transmitted through the insert to the surface of the well. The insert is placed within the primary wellbore so that the lateral bore is located and oriented adjacent the lateral borehole allowing production fluid from the lateral borehole to be transmitted to the surface of the well.

Thus, the present invention comprises a combination of features and advantages which enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein:

FIG. 5 is an end view of a high pressure non-concentric embodiment of the tieback insert of the present invention;

FIG. 6 is a side elevation view in cross-section of the high pressure non-concentric insert of FIG. 5;

FIG. 7 is a cross-sectional view of a seal assembly for sealing with the insert;

FIG. 8 is a schematic view of the high pressure non-concentric insert with access plug installed in a multi-lateral well;

FIG. 9 is a side cross-sectional view of a low pressure tieback insert installed in the junction of a lateral borehole and a primary wellbore;

FIG. 10 is a cross-sectional view taken along lines 10—10 in FIG. 9;

FIGS. 11A1, A2, and A3 is a cross-sectional elevation view of the tieback assembly of FIGS. 9 and 10 being lowered into the primary wellbore for installation on a reference tool and big bore packer;

FIGS. 11B1, B2, B3 is a cross-sectional elevation view of the tieback assembly of FIGS. 9 and 10 installed in the well and a liner extending through the insert and into the lateral borehole; and FIGS. 11C1, C2, and C3 is a cross-sectional elevation view of the tieback assembly of FIGS. 9 and 10 installed in the well with a liner completely disposed within the lateral borehole and a straddle extending through the insert to the liner.

DETAILED DESCRIPTION OF THE PREFERRED EMBODIMENTS

Figure 1:
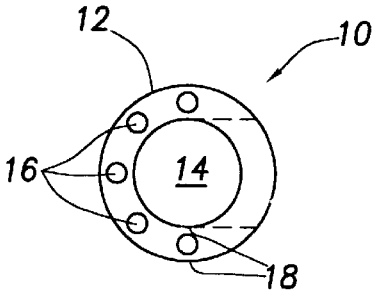
FIG. 1 is an end view of a high pressure concentric embodiment of the tieback insert of the present invention.

The present invention relates to methods and apparatus for sealing around a window cut in a casing and extending a liner into a lateral borehole. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

In particular, various embodiments of the present invention provide a number of different constructions and methods of operation. It is to be fully recognized that the different teachings of the embodiments discussed below may be employed separately or in any suitable combination to produce desired results. Reference to up or down will be made for purposes of description with up meaning toward the surface of the well and down meaning toward the bottom of the primary wellbore or lateral borehole.

Figure 2:
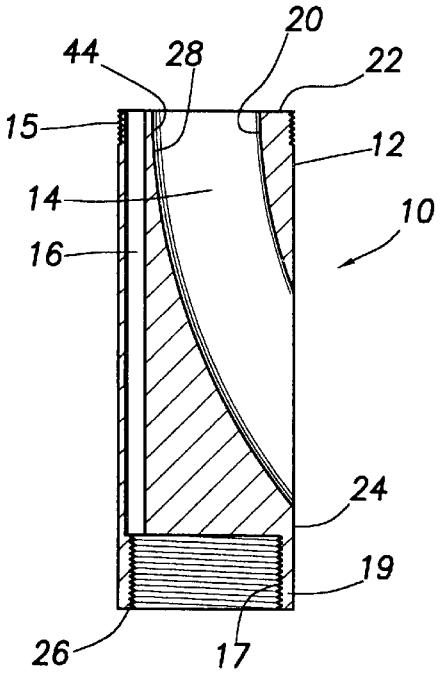
FIG. 2 is a side elevation view in cross-section of the high pressure concentric insert of FIG. 1.

Referring initially to FIGS. 1 and 2, there is shown a concentric embodiment of a tieback insert 10 including an integral housing or body 12 having an off shoot concentric lateral bore 14 and one or more axial flow bores 16. Body 12 is manufactured out of a solid metal bar stock with lateral bore 14 and axial bores 16 being individually gun drilled through the bar stock. Each of the walls, such as at 18, formed by bores 14, 16 as the bores are cut in the bar stock, are calculated to have an adequate thickness so as to withstand the pressure of the fluids passing through bores 14, 16. With solid walls between the bores as shown in FIG. 2, the integrity of each of the bores 14, 16 is only a function of the diameter of the bore and the thickness of the thinnest portion of wall 18.

Off shoot lateral bore 14 includes a cylindrical upper portion 20 concentrically centered in the upper terminal end 22 of body 12 with bore 14 then extending downwardly and laterally along a continuous arcuate axis and out through the cylindrical side 24 of body 12 adjacent its lower end to provide a lateral guide bore exiting body 12 for entering a lateral borehole. Lateral bore 14 preferably has a circular cross-section through out its length.

Axial bores 16 extend axially through body 12 from upper terminal end 22 to lower terminal end 26 of body 12. Axial bores 16 have a diameter which is necessarily smaller than that of lateral bore 14 since axial bores 16 are disposed between the wall 28 forming lateral bore 14 and the exterior surface of cylindrical side 24 of body 12. The lateral bore 14 includes an upper seal bore 44 to receive a seal assembly, as hereinafter described, to isolate and seal off a liner extending into the lateral borehole. It should be appreciated that axial bores 16 are not gun drilled through that area occupied by lateral bore 14. The bores 14, 16 form conduits through the body 12 of insert 10 which are isolated from each other whereby a first conduit formed by lateral bore 14 can be sealed from one or more second conduits formed by axial bores 16. Axial bores 16 form fluid passageways through insert 10 to provide fluid communication between the primary wellbore 32 and the surface.

Lateral bore 14 has a first cross-section with axial bores 16 each having a smaller cross-section but preferably all of the axial bores 16 having an aggregate cross-sectional area substantially equal to that of the lateral bore 14 to provide adequate fluid flow through the primary wellbore 32 from below the tieback insert 10 and then through the insert 10, allowing production to the surface from one or more producing zones in the primary wellbore. It should be appreciated that should production through the primary wellbore 32 be unnecessary or undesirable, axial bores 16 may be isolated and/or sealed off. It should also be appreciated that although bores 14, 16 are shown having a circular cross-section, bores 14, 16 may have another shape cross-section. For example, bores 16 may be oval shaped, oblong shaped, arcuate shaped or another shape which may conform to the curvature of the outer surface of housing 12 and inner surface of bore 14. A shape other than circular may allow the flow area through insert 10 to be increased.

A connection is provided on each end of body 12. For example exterior pin threads 15 may be provided around the top of body 12 for connecting an annular pack-off 65, hereinafter described, to insert 10, and interior box threads 17 may be provided inside the box end 19 of body 12 for connecting a latch sub for stabbing into a lower packer 122, hereinafter described.

Figure 3:
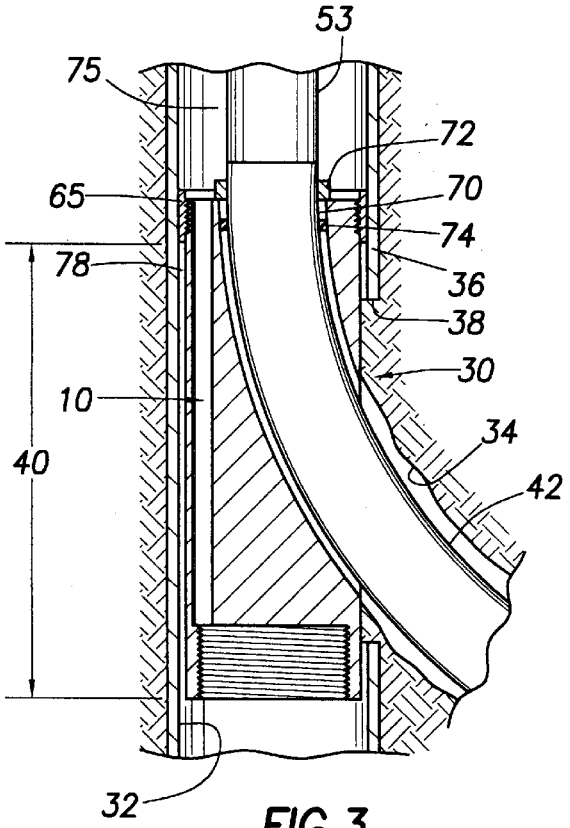
FIG. 3 is a schematic view of the high pressure concentric insert of FIGS. 1 and 2 installed in a multi-lateral well.
Figure 4:
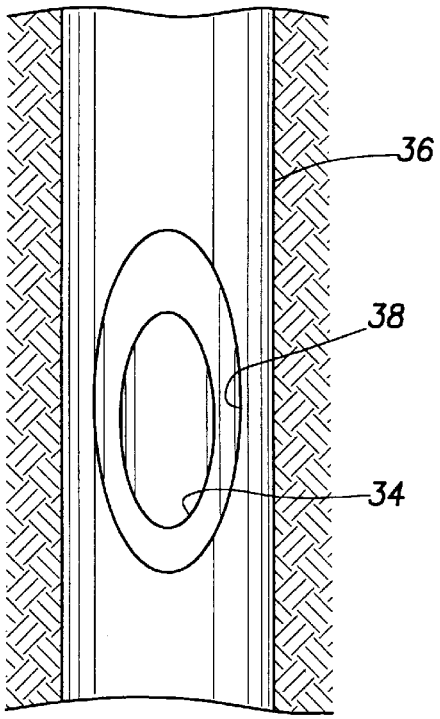
FIG. 4 is a schematic elevation view of a window cut in a casing with the insert installed.

Referring now to FIGS. 3 and 4, the tieback insert 10 is shown disposed in the junction 30 of a primary wellbore 32 and a lateral borehole 34. A casing 36 extends through primary wellbore 32 and includes a window 38 which has been milled through the wall of casing 36. Body 12 has a length 40 which is sufficient to straddle or bridge the hole or window 38 cut in the casing 36 from a point above the window to a point below the window. The axial bores 16 also bridge window 38 to communicate the primary wellbore 32 below window 38 with the wellbore above the insert 10.

The tieback insert 10 and the casing 36 form an outer annulus 78 therebetween which extends all the way around the window 38. Outer annulus 78 is merely the clearance between the insert 10 and the casing 36. This clearance is only that necessary to pass the insert 10 through the cased borehole and can be sealed off at both the top and the bottom since the outer annulus 78 forms a gap which is exposed to the joint at the window 38. To seal outer annulus 78, an upper packer such as an annular packoff 65 is connected by threads 15 to the top of body 12. Upon installation of insert 10, annular packoff 65 is actuated to seal off outer annulus 78.

The lateral bore 14 extends from the wellbore above window 38 to lateral borehole 34. This allows the wall 28 of lateral bore 14 to guide and divert a liner 42 into the lateral borehole 34. Thus, the tieback insert 10 acts as a guide and diverter for the liner 42.

When the lateral well 34 is completed, and the liner 42 is disposed inside lateral bore 14 and lateral borehole 34, the cross-sectional area through the liner 42 and through the axial bores 16 is preferably substantially equal. For example, typically the cased primary wellbore 32 has an 8½ inch borehole and the liner 42 has a 4½ inch outside diameter and a 4 inch inside diameter. A 4 inch inside diameter has approximately 12.6 square inches of flow area. Thus to achieve approximately the same flow area for the primary wellbore 32, 3 to 5 axial bores 16 are provided through body 12 to achieve a comparable 12.6 square inches of flow area to the primary wellbore 32. The inside diameter of the lateral bore 14 should be large enough, preferably at least 5¼ inches, to accommodate 4½ inch liner 42. Even though the cross-sectional area through lateral bore 14 is approximately twice as great as the aggregate cross-sectional area of 12.6 inches through axial bores 16, when liner 42 is disposed in lateral bore 14, the flow area through the liner 42 is approximately the same as the flow area through axial bores 16 communicating with the lower primary wellbore 32. Since it is anticipated that there always will be a liner 42 passing through lateral bore 14, it is the flow area of the liner 42 that must be comparable to the flow areas of axial bores 16 to the primary wellbore 32 and not the area of lateral bore 14. No liner is necessary for the axial bores 16 communicating with the primary wellbore 32. A tubing string 53 can be attached to the upper end of liner 42 to extend to the surface for the production of fluids from lateral borehole 34.

Referring now to FIGS. 5 and 6, there is shown a non-concentric embodiment of a tieback insert 50 including an integral housing or body 52 having an off shoot non-concentric lateral bore 54, an axial access or re-entry bore 56 and one or more ancillary bores 57. The non-concentric lateral bore 54 is adjacent that wall through which the lateral bore 54 protrudes. The lateral bore 54 also has an upper seal bore 68 for sealing with a sealing assembly, hereinafter described, on the liner 42. The non-concentric tieback insert 50 is only distinguished from the concentric tieback insert 10 by locating the lateral bore 54 off-center or non-concentrically in the upper terminal end 62 of body 52. By off-setting the lateral bore 54 in body 52, additional wall thickness is provided at 58 thereby allowing access bore 56 to have a diameter which will allow the passage of well tools through bore 56 for access to the primary wellbore 32 below tieback insert 50. Non-concentric lateral bore 54 is moved against cylindrical side wall 64 as close as possible and still maintain pressure rating integrity. The lateral bore 54 has an arcuate curvature to provide a ramp 106 for guiding liner 42 into lateral borehole 34.

The re-entry or access bore 56 is large enough, preferably greater than 2 inches, to accommodate small well tools. To get the necessary flow area, two to five ancillary bores 57 are also gun drilled through the insert 50 to achieve an equivalent flow area to that achieved through the liner 42. For example, assuming a 9⅝ inch casing 36 providing an 8⅝ inch inside diameter for tieback insert 50, lateral bore 54 preferably has a 5¼ inch inside diameter and access bore 56 has an inside diameter of 2¼ inches. It should be appreciated that these dimensions can vary and will vary with the inside diameter of the cased borehole.

By off-setting the lateral bore 54, the non-useable cross-sectional area 66 shown in FIG. 5 is minimized. Also by reducing area 66 through non-concentric placement of lateral bore 54, re-entry can then be achieved through axial bore 56 as well as provide adequate flow area through ancillary bores 57 for primary wellbore 32. The access bore 56 provides access to the primary wellbore 32 beneath the tieback insert 32 after the insert is in place and allows re-entry for tools and coiled tubing into the primary wellbore 32. Re-entry to the primary wellbore 32 may be necessary for stimulation of the original production zone.

Referring again to FIG. 3, initially, an assembly including a mill, whipstock, setting tool, debris barrier and a big bore packer (not shown) is lowered into the primary wellbore 32. The big bore packer is set and the mill is released from the whipstock. The mill then cuts the window 38 in casing 36 and the mill is retrieved. A drill string is then lowered and the lateral borehole 34 is drilled. The whipstock is then removed leaving only the big bore packer preferably with a reference receptacle.

The tieback insert 10, 50 is then run into the primary wellbore 32 preferably on a latch. The lower end of the insert 10, 50 is stabbed into the big bore packer in the primary wellbore 32 and becomes aligned with the window 38 in the casing 36 as it is stabbed into the big bore packer. The insert 10, 50 is oriented by the reference receptacle with respect to height and angular orientation for alignment with the window 38. See U.S. patent application serial No. 60/134,799 filed May 19, 1999 entitled "Well Reference Apparatus and Method", hereby incorporated herein by reference.

A seal is provided between the tieback insert 10, 50 and the liner 42. For example a seal assembly 70 may be disposed at the upper end of the liner 42 and stabbed into the seal bore 20, 68 of the lateral bore 14, 54 to seal internally at 74 with insert 10, 50. FIG. 7 shows the seal assembly 70 having a seal body 80 with seals 82, such as o-rings, mounted in grooves 84 in the exterior of body 80. The inside diameter of body 80 will be substantially the same as liner 42 and its outside diameter allows seals 82 to be received and compressed within seal bore 20, 68 of lateral bore 14, 54 in insert 10, 50. Annular pack off 65, disposed on insert 10, 50 by threads 15 on the upper terminal end 22, 52 of insert 10, 50, seals off the outer annulus 78. The annular pack off is a conventional piece of equipment. The location of the upper packer may be at various locations depending upon the completion.

The liner 42 is then lowered through the lateral bore 14, 54 and guided along the arcuate surface of lateral bore 14, 54 into the lateral borehole 34. A shoot (not shown) may be placed in the upper end of the lateral bore 14, 54 to guide liner 42. The upper end of liner 42 includes a liner hanger 72 which supports liner 42. The liner hanger 72 does not pack off the borehole, otherwise access to the primary lower borehole 32 would be blocked off. Liner 42 is supported within the lateral bore 14, 54 at its upper end and then extends down through the lateral bore 14, 54 and then through the lateral borehole 34.

It is necessary to be able to produce through the lateral borehole 34 and produce through the primary borehole 32 while all joints at junction 30 are completely sealed off. Thus, the big bore packer seals the insert 10, 50 below the window 38 and the upper packer, such as the annular pack off 65, seals the insert 10, 50 with casing 36. Further the seal assembly 70 seals the insert 10, 50 and liner 42 above the window 38. The upper and lower packers with insert 10, 50 provide a sealed junction 30 with the insert 10, 50 becoming an integral part of the junction.

There is production through both the primary borehole 32 and the lateral borehole 34. Typically production from primary wellbore 32 will pass up the annulus 75 and production from lateral borehole 34 will pass up the flow bore of tubing string 53 to the surface. Production may or may not be commingled above insert 10, 50. There are various reasons for not commingling the production from borehole 32, 34. The hydrocarbons from the two production zones may be so different that they should not be commingled. For example, one production zone may be producing oil and the other may be producing predominantly gas. Further, the pressures in the two reservoirs may be substantially different so as to cause one to purge into the other.

Another alternative is to extend the liner 42 all the way to the surface so as to produce the lateral borehole 34 through the liner 42 and then produce the primary wellbore 32 through the annulus 75 formed between the liner 42 and casing 36. A still another alternative is dispose a splitter on top of the tieback insert 10, 50.

The junction may not necessarily be cemented around the liner 42. The liner 42 may include wire wrapped screens which are mounted on the end of the liner 42 and which are installed inside the earthen lateral borehole 34 adjacent the producing formation. However, the liner 42 could be cemented. There are various methods for cementing liner 42. One is by reverse flow which is done conventionally. The other is performing a "squeeze" where the cement is forced down around the liner 42 until the cement reaches junction 30 between liner 42 and insert 10, 50. The cement mechanically stabilizes the joint at the junction 30.

The tieback insert assembly is retrievable unless the assembly has been cemented in place. To retrieve the insert 10, 50, the liner 42 is first removed. With the liner 42 removed, the insert 10, 50 is fished out of the well. In a workover, the well is killed, including the production zones in the lateral borehole 34 and the primary wellbore 32, and the liner 42 pulled and removed from the well. The workover is then performed and the well re-completed. If the liner 42 is cemented in the lateral borehole 34, insert 10, 50 may be milled down along with the upper end of the liner 42. The remaining part of the insert 10, 50 can then be retrieved.

Although the insert 10, 50 preferably includes seals for sealing the junction 30 between the primary wellbore 32 and lateral borehole 34, merely installing and bridging the insert 10, 50 across the window 38 substantially reduces the exposure to the formation. The diameter of the insert 10, 50 provides a much smaller annular clearance at annulus 78 with casing 36 than would a liner extending through the casing, out through the window 38 and into the lateral borehole 34. For example, the casing may be 8¾ inch inside diameter and the insert may have an outside diameter of 8⅜ inch.

The insert 10, 50 is used for basic control and containment of the junction 30. The packers and seal assembly on the insert 10, 50 achieve a totally sealed junction.

The tieback insert 10, 50 provides for a level five high pressure multi-lateral junction because it provides hydraulic integrity at the junction 30 for pressures generally in excess of 1000 psi.

The objective of the insert 10, 50 is to provide a bore that is isolatable from the lateral borehole 34, a junction 30 that is sealed off, and an exit through the window 38 that is scaled off. The window 38 will have a generally unknown shape thus making it difficult to seal off. The purpose of the insert 10, 50 is not just to divert liner 42 into lateral borehole 34 but to provide a seal around the window 38 cut in casing 36.

Referring now to FIG. 8, there is shown an alternative embodiment of insert 50. The tieback insert 90, shown in FIG. 8, includes a removable plug 92 disposed in a plug bore 94 which extends from the ramp surface 106 formed by the arcuate bottom of lateral bore 54 to the box end 19 of the insert 10, 50. The plug 92 is wireline or tubing retrievable. By pulling plug 92 and having liner 42 removed, access to the primary wellbore 32 may be obtained through plug bore 94 via lateral bore 54. The lateral bore 54 is preferably non-concentric as shown.

To prevent liner 42 from hanging up in the opening or mouth 96 of plug bore 94, a casing shoe (not shown) may be disposed on the lower end of liner 42 and which has a diameter which will not fit into plug opening 96. In other words, the hole for plug 92 is slightly smaller than the casing shoe.

Since lateral bore 54 is larger than access bore 56, plug bore 94 provides a larger diameter access to primary wellbore 32 below insert 90. It should be appreciated that axial bores 56, 57 still provide flow access to primary wellbore 32.

In operation, the anchor/packer, whipstock and mill are lowered into the well and set. The window 38 is then milled in casing 36 and the lateral borehole 34 is drilled. Before insert 90 is installed, a liner 100 is lowered through lateral bore 54 and into lateral borehole 34. The liner 100 can be larger than liner 42 because liner 100 is not installed through insert 90 where liner 42 was installed through lateral bore 14, 54 in insert 10, 50. With the embodiment of FIG. 8, a 7 inch liner can be run into lateral borehole 34 where the lateral borehole 34 is approximately 8½ inches to accommodate the liner.

The liner 100 is preferably run in while the whipstock is still in place so that the whipstock can assist in guiding the liner 100 into the lateral borehole 34. The whipstock is then retrieved after installing liner 100. Once the whipstock is pulled out of the big bore packer, both zones are open because the whipstock is no longer sealed with the big bore packer. The insert 90 is then lowered, stung in the big bore packer and aligned with window 38. Once the tieback insert 90 is stabbed into the big bore packer and the annular pack off 65 is set, window 38 then can be sealed off from primary wellbore 32.

Liner 100 has an upwardly facing seal bore 102 for sealingly receiving a straddle 104. The plug bore 94 has a smaller diameter than that of straddle 104 so that straddle 104 cannot get hung up in bore 94. Even if liner 100 is a 7 inch liner, it should be appreciated that straddle 104 still has to pass through lateral bore 54. The top of the liner 100 is disposed in the lateral borehole 34 so that once the straddle 104 is removed, the plug 92 can be removed or the entire tieback insert 90 retrieved. The straddle 104 is then lowered through lateral bore 54 and stabbed and sealed inside seal bore 102 of the liner 100. The straddle 104 extends from the top of liner 100 and through the lateral bore 54 to the top of insert 90. Straddle 104 is sealed at its upper end to tieback insert 90 by a packer 106. Liner 100 then may be cemented into the lateral borehole 34. It should be appreciated that a tubing string, such as string 53, may be connected to the top of straddle 104.

To obtain access to the plugged off plug bore 94, straddle 104 is removed and plug 92 is retrieved. The straddle 104 is much easier to retrieve out of the lateral borehole 34 than the full liner 100.

It should also be appreciated that an external packer can be run on liner 100 just below seal bore 102 to seal off the annulus around liner 100. Liner 100 can then be cemented up to the packer.

The embodiments of FIGS. 1–8 are level five high pressure multi-laterals. These embodiments will withstand pressures over 1000 psi.

Referring now to FIGS. 9–11A–C, there is shown a level five low pressure multi-lateral which can withstand pressures up to around 1000 psi. The low pressure embodiment has less pressure integrity than that of the high pressure embodiments for pressures greater than 1000 psi.

Referring now particularly to FIG. 9, there is depicted a portion of a subterranean hydrocarbon-production well 110 within a formation 112. In particular, the Figure shows junction 30 between primary wellbore 32 and lateral wellbore 34. Primary wellbore 32 is lined by casing 36 through which window 38 has been milled. Casing 36 may be cemented in place within the primary bore 32, in a manner that is well known. No cement is shown, however, for clarity.

A low pressure tieback insert 120, which has been constructed in accordance with the present invention, is shown disposed within the primary wellbore 32. The insert 120 is seated on a seating packer, such as a big bore packer 122, located below the lateral wellbore 34. A packer is typically set at a known reference depth prior to milling the window 38 and, thus is located at a predetermined distance below the window 38. For purposes of this discussion, the portion of the wellbore 32 above the insert 120 will be referred to as the upper wellbore 124.

The insert 120 includes an outer, generally cylindrical housing 126 which defines a longitudinal, axial annular fluid passage 128 therethrough. The outer housing 126 is preferably formed from steel or another hardened metal, but may be formed of other suitable substances if desired. A substantially circular opening (the edges of which are shown at 130) is cut into the housing 126. The lower end of the housing 126 includes a reduced diameter pin-type portion 131 adapted to be seated into a generally complimentary shaped latch and seal bore (not shown) that is associated with packer 122 discussed above.

The insert 120 also includes an inner tubular conduit 132 that is located radially within the outer housing 126. The conduit 132, like the housing 126, is preferably formed of a hardened metal, such as steel. Other suitable substances may be used if desired. The conduit 132 is preferably disposed concentrically within housing 126 at it supper end forming a bore within a bore. The conduit 132 defines an interior flow passage or lateral bore 134. Conduit 132 is disposed within the housing 126 so that the upper end 136 of the conduit 132 is substantially co-axially secured within the housing 126. This relationship is better appreciated by reference to FIG. 10 which illustrates the co-axial relation. The upper end 136 is also secured to the housing 126 so that the conduit 132 is disposed in a spaced relation from the housing 126 so that an annular space 138 is formed between the two. In the exemplary embodiment depicted, a plurality of fins 140 are used to affix the upper end 136 of the conduit 132 to the housing 126 in this manner.

It is noted that other structures and arrangements might also be used to maintain the upper end 136 in such a spaced relation. It should be appreciated that disposing the upper end 136 of conduit 132 concentrically within housing 126 allows fluid access to the primary bore 32 but does not provide adequate access for well tools or coiled tubing and that the upper end 136 of conduit 132 may disposed non-concentrically within housing 126 such as shown in FIGS. 5 and 6 to provide access for well tools or coiled tubing.

It should also be appreciated that insert 110 made be made with a series of conduits. For example, with the upper end 136 of conduit 132 in the non-concentric position within cylindrical housing 126, axial access bores, similar to bores 56, 57 shown in FIG. 5, may be provided by conduits which are also disposed within cylindrical housing 126. Thus the insert 110 may be made up of conduits 126, 132, and by axial access conduits providing bores similar to that of bores 56, 57. The ends of the series of conduits would be secured together by a mechanism like fins 140 or a support plate.

The lower end 144 of the conduit 132 is affixed to the edges 130 of the opening 142 so that fluids communicated into the opening 142 will be transmitted into the interior lateral bore 134 of the conduit 132.

It is currently preferred that welding equipment be used to cut the opening 142 in the housing 126 and to affix the lower end 144 of the conduit 132 to the edges 130 of the opening 142. In the manufacture of insert 120, a precise window is cut in the housing 126. A pre-bent tubular is then slid through the window to form conduit 132. That portion of the bent inner conduit 132 which extends from housing 126 is cut off at the outer surface of the housing 126 and the housing 126 and conduit 132 are welded together at their interface. After welding, the entire insert 120 is turned in a lath to ensure the outside of housing 126 is cylindrical and to remove any irregularities.

It will be appreciated that the insert 120 provides a dual flow path for production fluids. One flow path permits fluids to be communicated from the primary wellbore 32 through the annular space 138 within the insert 120 and into the upper wellbore 124. The second flow path communicates fluids from the lateral borehole 32 through the lateral bore 134 of the conduit 132 and into the upper wellbore 124. In use, then, fluid is produced into the upper wellbore 124 from both the primary wellbore 32 and the lateral borehole 34.

The insert 120 is preferably disposed into the wellbore 110 through tubing conveyance. It will be appreciated that the azimuthal orientation of the lateral bore 134 will be known as a result of the milling and sidetracking procedures which necessarily will precede the use of the insert 120. As a result, the insert 120 should be disposed into the wellbore 110 so that the opening 142 is oriented substantially so as to face the lateral borehole 34.

If desired, a directional latch can be used to secure the insert 120 to packer 122. The directional latch has a lug or other key on its seating surface adapted to match a complimentary structure on the pin end 131. When seated, the insert 120 thus be automatically is oriented to a proper azimuthal position with respect to the lateral borehole 34.

A liner, such as liner 42, (not shown) will be run into the lateral borehole 34 once the insert 120 is in place. Cement can be used to secure the liner and the insert 120 into position. The liner is disposed down through the upper wellbore 124 and interior lateral bore 134 so that it enters the lateral borehole 34. The liner may be many thousands of feet long.

Referring now to FIGS. 11A–C, there is shown a preferred embodiment of installing the insert 120. An assembly 150 includes reconnection member 152, debris barrier 154, and a connector sub 156 for connecting to the lower end of tieback insert 120. A running tool 158 on the lower end of a drill string 160 is connected to the upper end of tieback insert 120. One preferred embodiment is shown and described in U.S. Provisional Patent Application Serial No. 60/134,799, filed May 19, 1999, hereby incorporated herein by reference. Tieback insert 120 includes a main axial bore 128 and a lateral bore 134. Main axial bore 128 is to be aligned with the existing primary wellbore 32 while the lateral bore 134 is to be aligned with one of the lateral boreholes such as for example lateral borehole 34. For lateral bore 134 to be properly aligned with lateral borehole 34, it is necessary that the tieback insert 120 be properly oriented within existing primary wellbore 32. In operation, the assembly 150 is assembled at the surface with lateral bore 134 properly aligned on latch 152 so as to be in proper alignment with lateral borehole 34 upon orientation and latching with reference member 164 and anchor member 166.

As shown in FIG. 11B, a liner 42 is shown installed through lateral bore 134 and in lateral borehole 34. As shown in FIG. 11C, a liner 100 is shown completely inserted in lateral borehole 34 and a straddle 104 is shown sealingly stabbed in the seal bore 102 at the top of liner 100.

While a preferred embodiment of the invention has been shown and described, modifications thereof can be made by one skilled in the art without departing from the spirit of the invention.

What is claimed is:

1. An apparatus for an aperture in the wall of a cased wellbore, comprising:

a housing having first and second ends and a cylindrical side;

a first passageway providing fluid communication between said first end and said second end through said housing;

a second passageway extending from said first end and laterally through said side; and said first passageway not being in fluid communication with said second passageway.

2. The apparatus of claim 1 wherein said second passageway is concentric with said side at first end.

3. The apparatus of claim 1 wherein said second passageway is non-concentric with said side at said first end.

4. The apparatus of claim 1 wherein said first passageway has a cross-sectional area sufficient for the passage of well tools and coiled tubing.

5. The apparatus of claim 1 wherein said housing and said first and second passageways are conduits.

6. The apparatus of claim 1 wherein said second passageway has a portion with a straight axis and a portion with continuous arcuate axis.

7. The apparatus of claim 1 wherein said housing includes a first conduit forming said first passageway and a second conduit forming said second passageway, said second conduit having one portion disposed within said first passageway and a second portion extending through a hole in a side wall of said first conduit.

8. The apparatus of claim 7 wherein said first conduit forms said housing.

9. An apparatus for an aperture in the wall of a cased wellbore, comprising:

a housing having first and second ends and a cylindrical side;

a first passageway providing fluid communication between said first end and said second end through said housing;

a second passageway extending from said first end and laterally through said side; and said housing being made from bar stock.

10. An apparatus for an aperture in the wall of a cased wellbore, comprising:

a housing having first and second ends and a cylindrical side;

a first passageway providing fluid communication between said first end and said second end through said housing;

a second passageway extending from said first end and laterally through said side; and at least a third passageway extending from said first end to said second end through said housing, said second passageway having a cross-sectional area approximately twice the aggregate cross-sectional areas of said first and third passageways.

11. An apparatus for an aperture in the wall of a cased wellbore, comprising:

a housing having first and second ends and a cylindrical side;

a first passageway providing fluid communication between said first end and said second end through said housing;

a second passageway extending from said first end and laterally through said side; and a liner extending through said second passageway and said housing including at least a third passageway extending from said first end to said second end through said housing, said liner having a cross-sectional area approximately the same as the aggregate cross-sectional areas of said first and third passageways.

12. An apparatus for an aperture in the wall of a cased wellbore, comprising:

a housing having first and second ends and a cylindrical side;

a first passageway providing fluid communication between said first end and said second end through said housing;

a second passageway extending from said first end and laterally through said side; and said first and second passageways being gun drilled through said bar stock.

13. An apparatus for an aperture in the wall of a cased wellbore, comprising:

a housing having first and second ends and a cylindrical side;

a first passageway providing fluid communication between said first end and said second end through said housing;

a second passageway extending from said first end and laterally through said side; and a first packer adjacent said first end and a second packer adjacent said second end; said packers adapted for sealing with the cased borehole above and below the aperture.

14. An apparatus for an aperture in the wall of a cased wellbore, comprising:

a housing having first and second ends and a cylindrical side;

a first passageway providing fluid communication between said first end and said second end through said housing;

a second passageway extending from said first end and laterally through said side; and said first passageway including a seal bore adjacent said first end.

15. The apparatus of claim 14 further including a sealing assembly sealingly engaging said seal bore.

16. An apparatus for an aperture in the wall of a cased wellbore, comprising:

a housing having first and second ends and a cylindrical side;

a first passageway providing fluid communication between said first end and said second end through said housing;

a second passageway extending from said first end and laterally through said side; and said second end including a member adapted for sealing engagement with a packer.

17. An apparatus for an aperture in the wall of a cased wellbore, comprising:

a housing having first and second ends and a cylindrical side;

a first passageway providing fluid communication between said first end and said second end through said housing;

a second passageway extending from said first end and laterally through said side; and said first end has a connector adapted for connecting with an annular pack off.

18. An apparatus for an aperture in the wall of a cased wellbore, comprising:

a housing having first and second ends and a cylindrical side;

a first passageway providing fluid communication between said first end and said second end through said housing;

a second passageway extending from said first end and laterally through said side;

said second passageway forming a ramp portion; and a third passageway extending from said ramp portion to said second end.

19. The apparatus of claim 18 further including a removable closure member disposed in said third passageway.

20. An apparatus for an aperture in the wall of a cased wellbore, comprising:

a housing having first and second ends and a cylindrical side;

a first passageway providing fluid communication between said first end and said second end through said housing;

a second passageway extending from said first end and laterally through said side;

said housing including a first conduit forming said first passageway and a second conduit forming said second passageway, said second conduit having one portion disposed within said first passageway and a second portion extending through a hole in a side wall of said first conduit; and supports attaching said second conduit within said first conduit.

21. An apparatus for an aperture in the wall of a cased wellbore, comprising:

a housing having first and second ends and a cylindrical side;

a first passageway providing fluid communication between said first end and said second end through said housing;

a second passageway extending from said first end and laterally through said side; said housing including a first conduit forming said first passageway and a second conduit forming said second passageway, said second conduit having one portion disposed within said first passageway and a second portion extending through a hole in a side wall of said first conduit; and said second end including a member adapted for sealing engagement with a packer.

22. An apparatus for an aperture in the wall of a cased wellbore, comprising:

a housing having first and second ends and a cylindrical side;

a first passageway providing fluid communication between said first end and said second end through said housing;

a second passageway extending from said first end and laterally through said side;

said housing including a first conduit forming said first passageway and a second conduit forming said second passageway, said second conduit having one portion disposed within said first passageway and a second portion extending through a hole in a side wall of said first conduit; and said first end having a connector adapted for connecting with an annular pack off.

23. An apparatus for a window cut in a casing in a well, comprising:

a housing disposed in the casing which bridges the window;

said housing including a first conduit communicating from above to below the window;

said housing including a second conduit in communication from above the window and with the window;

said second conduit adapted to serve as a guide for a liner;

said second conduit adapted for sealing engagement with the liner;

said first conduit sealed with respect to said second conduit; and said second conduit exiting laterally of said housing; and said first conduit is separate from said second conduit.

24. An apparatus for a window cut in a casing in a well, comprising:

a housing disposed in the casing which bridges the window;

said housing including a first conduit communicating from above to below the window;

said housing including a second conduit in communication from above the window and with the window;

said second conduit adapted to serve as a guide for a liner;

said second conduit adapted for sealing engagement with the liner;

said first conduit sealed with respect to said second conduit; and said second conduit exiting laterally of said housing; and a seal between the housing and casing above the window and a second seal between the housing and casing below the window.

25. An assembly for the junction of a primary cased wellbore having a window cut in the casing for a lateral borehole, comprising:

a housing having first and second ends and a cylindrical side, said housing adapted to bridge the window;

a first bore extending from said first end to said second end through said housing;

a second bore extending from said first end and laterally through said side, said second bore adapted for alignment with the window;

a first seal sealingly engaging said housing and adapted for sealing engagement with the casing above the window; and a second seal sealingly engaging said housing and adapted for sealing engagement with the casing below the window.

26. The assembly of claim 25 further including a liner having a sealing assembly with said liner extending through said second bore and adapted for extending into the lateral borehole, said sealing assembly sealingly engaging said housing and said liner.

27. The assembly of claim 25 further including a liner adapted for extending into the lateral borehole and a straddle having a sealing assembly and extending through said second bore, said straddle releasably connecting to said liner and said sealing assembly sealingly engaging said housing and said straddle.

28. The apparatus of claim 27 further including a third bore extending from said second bore to said second end and a removable closure member disposed in said third bore.

29. A method of lining a lateral borehole, comprising:

milling a window in the wall of casing in a wellbore;

drilling a lateral borehole;

installing a tieback insert bridging the window;

sealing the insert with the casing above and below the window;

inserting a liner through a lateral bore in the insert and into the lateral borehole; sealing the liner with the insert; and flowing fluids from below the insert, through at least one flow bore in the insert, and into the wellbore above the insert.

30. A method of lining a lateral borehole, comprising:

milling a window in the wall of casing in a wellbore;

drilling a lateral borehole;

inserting a liner completely into the lateral borehole;

installing a tieback insert bridging the window;

sealing the insert with the casing above and below the window;

inserting a straddle in the lateral bore and attaching one end to the top of the liner in the lateral borehole;

sealing the straddle with the insert; and flowing fluids from below the insert, through a flow bore in the insert, and into the wellbore above the insert.

31. The method of claim 30, comprising passing well tools through the flow bore and into the wellbore below the insert.

32. The method of claim 30, comprising removing the straddle and opening an access bore in the lateral bore to access through the lateral bore the wellbore below the insert.

* * * * *